US006700329B2

(12) United States Patent
Giapis et al.

(10) Patent No.: US 6,700,329 B2
(45) Date of Patent: Mar. 2, 2004

(54) METHOD AND APPARATUS FOR PROVIDING FLOW-STABILIZED MICRODISCHARGES IN METAL CAPILLARIES

(75) Inventors: Konstantinos P. Giapis, Pasadena, CA (US); Mohan Sankaran, Pasadena, CA (US); Michael J. Gordon, Arcadia, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 10/115,840

(22) Filed: Apr. 3, 2002

(65) Prior Publication Data

US 2002/0171367 A1 Nov. 21, 2002

Related U.S. Application Data

(60) Provisional application No. 60/282,949, filed on Apr. 10, 2001.

(51) Int. Cl.[7] ..... H01J 7/24

(52) U.S. Cl. ..... 315/111.21; 315/111.71; 315/111.31; 313/339

(58) Field of Search ..... 315/111.21, 111.31, 315/111.71, 111.81, 111.91; 313/339; 250/423 R, 424; 372/76, 88

(56) References Cited

U.S. PATENT DOCUMENTS 3,974,458 A * 8/1976 Aisenberg et al. ..... 372/88
4,626,648 A * 12/1986 Browning ..... 219/121.5
4,641,316 A * 2/1987 Collins et al. ..... 372/74
4,788,402 A * 11/1988 Browning ..... 219/76.16
4,812,040 A * 3/1989 Marcus et al. ..... 356/314
5,440,094 A * 8/1995 Zapletal ..... 219/121.52
5,785,824 A * 7/1998 Kitayama et al. ..... 204/176
6,010,636 A * 1/2000 Donohue et al. ..... 216/71
6,441,552 B1 * 8/2002 Brandenburg et al. .. 315/111.21

* cited by examiner

*Primary Examiner*—Haissa Philogene
(74) *Attorney, Agent, or Firm*—Daniel L. Dawes; Myers Dawes Andras & Sherman LLP

(57) ABSTRACT

Hollow cathode microdischarges in a tube geometry provides the formation of stable, high-pressure discharges in a variety of flowing gases including argon, helium, nitrogen, and hydrogen. Direct current discharges are ignited in stainless steel capillary tubes ($d_{hole}$=178 $\mu$m) which are operated as the cathode and using a metal grid or plate as the anode. Argon discharges can be sustained at atmospheric pressure with voltages as low as 260 V for cathode-anode gaps of 0.5 mm. In one embodiment using a molybdenum substrate as the anode, microjets are struck in $H_2/CH_4$ mixtures at 200 Torr to deposit diamond films with well-faceted crystals. Optical emission spectroscopy of discharges used for growth confirms the presence of atomic hydrogen and CH radicals. Ballasting of individual tubes allows parallel operation of the microjets for larger area materials processing.

32 Claims, 8 Drawing Sheets

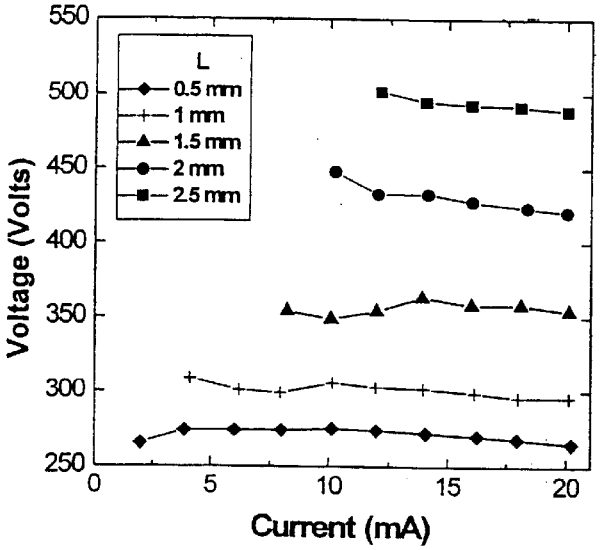
Fig. 2
Fig. 3
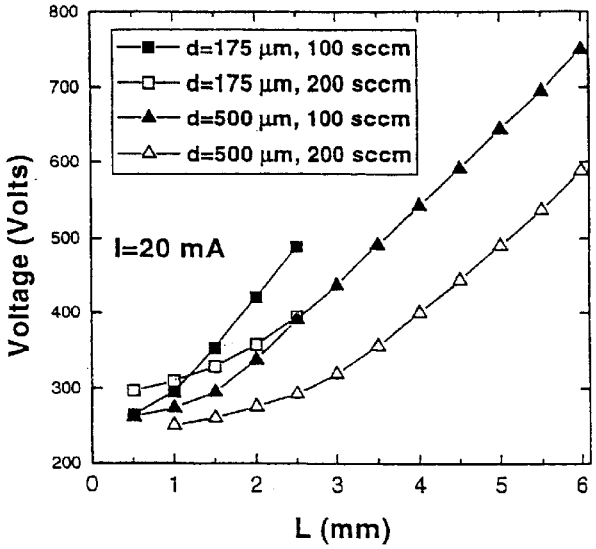

Fig. 7a
Fig. 7b
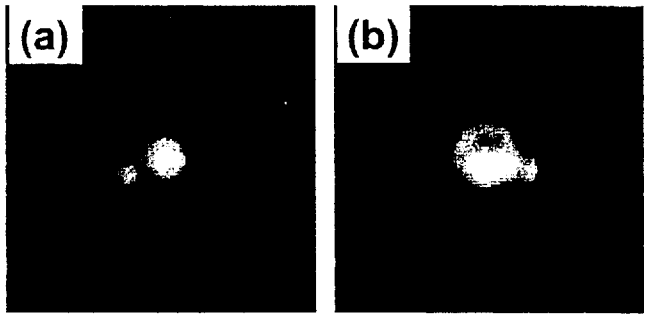
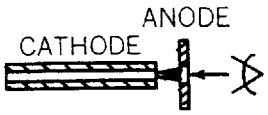
Fig. 7c
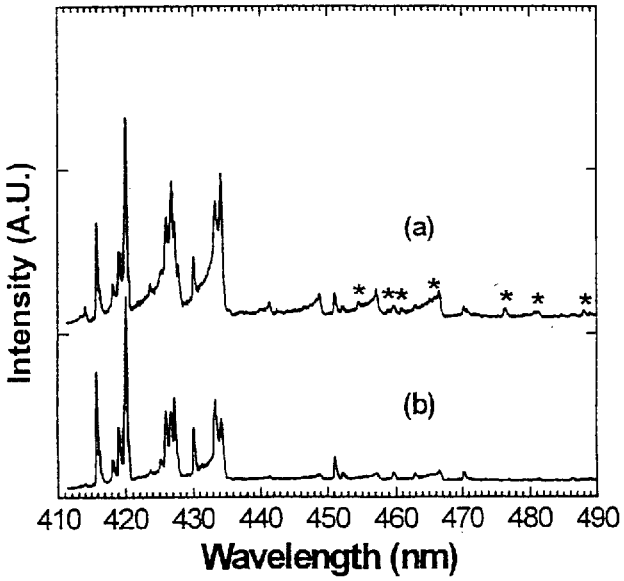

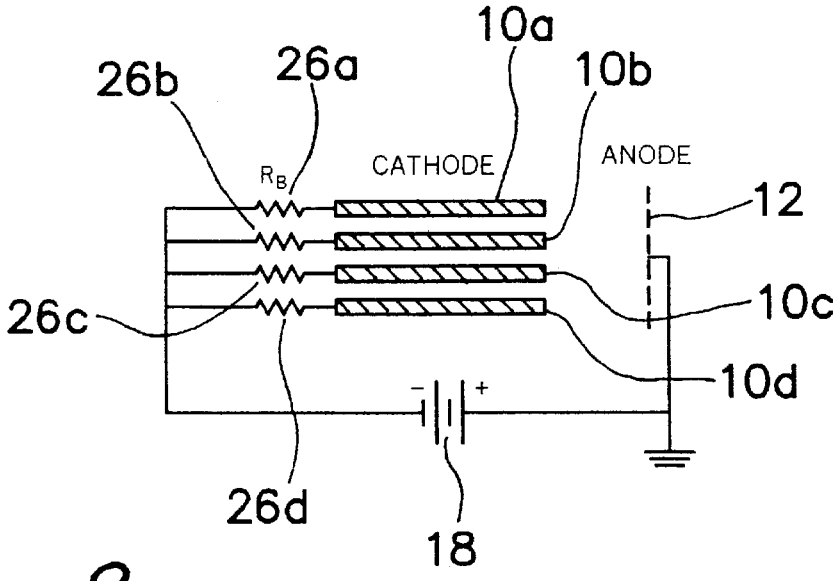
Fig. 8a
Fig. 8b
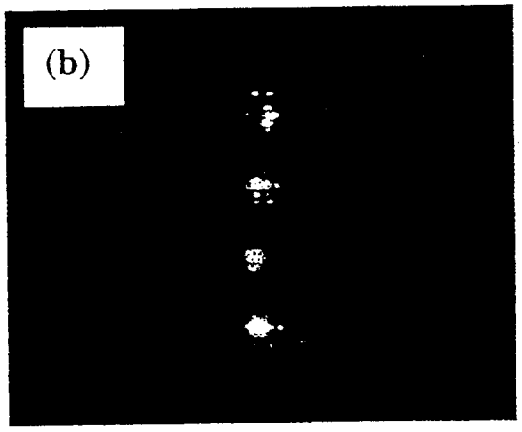
Fig. 8c
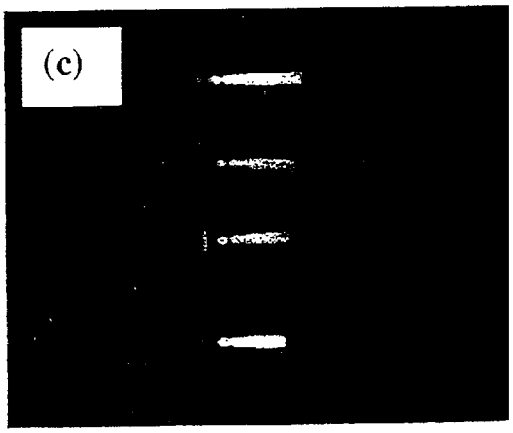

METHOD AND APPARATUS FOR PROVIDING FLOW-STABILIZED MICRODISCHARGES IN METAL CAPILLARIES

RELATED APPLICATIONS

The present application is related to and claims the priority under 35 USC 120 of U.S. Provisional application No. 60/282,949 filed on Apr. 10, 2001.

BACKGROUND OF THE INVENTION

1. Field of the Invention

The invention is related to the field of microdischarges or plasmas in a tube geometry and in particular to direct current discharges at relatively high pressures using metal tubes which are operated as the cathode and using a metal grid or plate as the anode.

2. Description of the Prior Art

Hollow cathode microdischarges have gained recent attention due to their high pressure operation and intense UV radiation. The discharges are characterized by higher current densities ( up to 10 A/cm$^2$) at lower operating voltages in comparison to conventional glow discharges at similar conditions. Furthermore, optical studies have shown the presence of highly excited states such as neon ions more than 50 eV above ground states and excimers. Therefore, it is believed that these discharges contain a large concentration of high-energy electrons making them potentially useful as UV lamps and plasma reactors.

While various electrode geometries have been explored to take advantage of the hollow cathode, in general, a thin metal plate less than 200 $\mu$m thick with an aperture between 100–700 $\mu$m in diameter serves as the cathode. The pressure at which the discharge can be operated has been shown to depend inversely on the hole diameter with atmospheric-pressure operation requiring diameters less than 250 $\mu$m in rare gases and less than 100 $\mu$m in air. Devices in most of these cases consist of a metal-dielectric-metal structure with a hole through all three layers. Recently, the structure has also been expanded to multilayer structures in order to increase the active length of the device. Lifetime and stability of microdischarges in this configuration are limited by the dielectric, often a polymer, which can fail due to deposition of sputtered cathode material and thermal decomposition. Because of these concerns, discharge currents are often kept below 7 mA to extend the lifetime of devices. Multilayer structures also suffer from complex fabrication steps with only small increases in the total length of the device.

Hollow cathode microdischarges in the prior art are stable, high-pressure discharges formed between a cathode with a hole and an anode of arbitrary shape. It has been previously found experimentally that it is necessary to reduce the cathode hole diameter to near 100 $\mu$m to allow operation at atmospheric pressure in rare gases such as neon, argon, and xenon. The electrode geometry usually consists of a sandwich structure of two metal plates on either side of a thin dielectric spacer. Discharges are struck in the confined volume between the metal electrodes in a direct current mode with similar voltages used for conventional glow discharges, but much larger current densities.

The increase in the number of ionization processes is caused by the Pendel effect, which is the oscillatory motion of electrons in the radial electric field created by the hollow cathode. Optical studies in rare gases have confirmed the presence of a large concentration of high energy electrons by the emission of excimer radiation and other highly excited states. These properties warrant the use of microdicscharges in materials processing where the production of reactive radicals at high pressures is often required. We have recently reported one such application where Ar/$CF_4$ microdischarges were used to etch silicon.

Tubes have been simultaneously used in the prior art as the gas inlet and cathode, but with openings of the order of 0.4–2 mm, which are much larger than those found in hollow cathode microdischarges. For this reason, the discharges were operated at lower pressures ($p<1$ Torr) and used radio frequency power which requires complicated impedance matching networks. Furthermore, in some cases, although operation was achieved at atmospheric pressures, the discharge was found to form on the surface of the electrodes and did not operate as a hollow cathode.

Further, such hollow cathode microdischarges have a flat or disk geometry in which the plasma is confined to the small disk-shaped space between opposing dielectric planes. This geometry excludes its usage in many applications where a projecting plasma onto a material substrate is needed. What is needed is some kind of method and apparatus having a geometry whereby hollow cathode microdischarges can be effectively and practically extended to interact with surfaces.

BRIEF SUMMARY OF THE INVENTION

An alternative concept to increasing the length of the cathode from that used in hollow cathode microdischarges is realized by forming multilayer structures to extend the hollow cathode to a tube geometry. This approach increases the length of the cathode by orders of magnitude. Furthermore, producing a discharge in a flow geometry would be more conducive for applications in air, such as gas detoxification and spectroscopy. Similar tube geometries have been previously used to operate atmospheric-pressure plasmas, but due to larger openings (0.4–2 mm) were observed to have surface discharge formation. The objective of the present invention is to show stable DC operation of a hollow cathode discharge at atmospheric-pressure in metal or conductive capillaries with openings less than 250 $\mu$m in diameter.

In a preferred embodiment of the invention it assumes a geometry in which microdischarges can be utilized as a radical source by providing a flow or jet where species produced in a hollow cathode are transported to a substrate. In order to obtain hollow cathode operation at high pressures or at least operation at atmospheric or subatmospheric pressures, further shrinking of the hole diameter is necessary, similar to that used for microdischarges in metal plates. The ability to form microdischarges using direct current bias in a flowing environment takes advantage of the properties of a hollow cathode and is advantageous for film deposition. In the illustrated embodiment flowing discharges in metal capillary tubes with hole sizes as small as 178 $\mu$m are described and used for the deposition of diamond films.

However, it must be expressly understood that the hollow cathode plasmas or flowing discharges of the invention can be used for any application and hole sizes of the tubular cathode may assume any value within a range of diameters consistent with the teachings and spirit of the invention.

In one embodiment, the plasma microjet is comprised of a stainless steel capillary 5 cm in length with a hole diameter of 178 $\mu$m. The capillary, operated as the cathode, was separated from a metal screen, which served as the counter electrode or anode. The screen was positioned by a linearly movable micrometer stage, which allowed for control of the distance between the cathode and anode. A negatively biased DC power supply operates the discharge with a current-limiting resistor (Rc) in series with the microjet. Gases such as argon and helium were flowed through the capillary using a mass flow meter with rates between 100–500 sccm. After the discharge was initiated, the plasma current-voltage (I–V) was monitored by measuring the voltage across resistors in series and parallel with the plasma. Current instabilities on short time scales were also observed using a digital oscilloscope. Argon discharges were characterized by optical emission spectroscopy using a SPEX 1680 double monochromator and a Hamamatsu photomultiplier tube model no. R928.

Breakdown voltages of the hollow cathode microjet depended inversely on the distance between the end of the capillary tube and the screen. Reducing this gap to less than 0.5 mm permitted breakdown of the gas at voltages less than 1000 V. After the discharge was initiated, the screen could be moved to extend the length of the discharge outside the tube. The appearance of the microjet was found to depend on both the gas flow rate and the distance between the cathode and anode (L). As the distance increased, the minimum current required to sustain the plasma increased with the plasma extinguishing below this value. The operating voltage of the discharge increased from 280 V to 400 V as the distance increased from 0.5 to 2.5 mm. The relationship between the sustaining voltage and distance is a super linear increase in voltage with distance. In the range of distances and current values studied, the microjet could be sustained with relatively few fluctuations and good stability over extended time periods of operation. Due to the stability of the discharge at low currents and voltages, it is believed that under these conditions the discharge behaves similar to a hollow cathode microdischarge. At higher currents and voltages, the fluctuations and instability may be the result of a transition of the plasma from a glow-like state to an arc.

More specifically, the invention is defined as an apparatus for combination with a source of gas comprising a conductive hollow elongate conduit or tube means, serving as a cathode, having a longitudinal axis and an exit orifice; a voltage source or means for providing direct or low frequency current having a negative terminal electrically coupled to the conductive hollow elongate conduit; and an anode or anode means electrically coupled to the voltage source and positioned at least at one point in time longitudinally distanced from the exit orifice of the conductive hollow elongate conduit. The voltage source typically operates at between 500 to 1500 volts depending on the desired plasma intensity. The source of gas is communicated with the conductive hollow elongate conduit to supply gas to the conductive hollow elongate conduit, so that upon application of the voltage to the conductive hollow elongate conduit a plasma is formed at least within the conductive hollow elongate conduit. In the preferred embodiment the anode is grounded, but in general there only need be a sufficient potential difference between the cathode and anode to strike a plasma. The source of gas may also be considered to be included as part of the apparatus in some embodiments or may be treated separately.

The source of gas provides a flow of gas through the conductive hollow elongate conduit so that a microjet of the plasma extends from the exit orifice and wherein the anode is downstream from the exit orifice. Even in the case where there is no flow of gas in the conduit or tube, the source of gas provides gas to the conductive hollow elongate conduit so that the plasma extends to the exit orifice.

In the preferred embodiment the conductive hollow elongate conduit is a metal tube, or more particularly a stainless steel tube. However, any conductive material may be used which is stable to the particular gas chemistry. Again, in the preferred embodiment the conductive hollow elongate conduit is a cylindrical tube with an inner diameter of approximately 200 $\mu$m or less.

The preferred form of the anode is a conductive plate, grid or screen, which is movable or removable at least in part. Again the invention is not limited to this form of the anode which may take many other equivalent forms, including multiple part anodes, which include both stationary and movable portions. In many applications the anode will be formed by a work piece, such as a MEMS device, the nature of which will be determined in each by the application.

The invention further comprises a plurality of conductive hollow elongate conduits, each having a longitudinal axis and an exit orifice, where the voltage source has its negative terminal electrically coupled to each of the conductive hollow elongate conduits, and where the anode is positioned at least at one point in time longitudinally distanced from the exit orifice of each of the conductive hollow elongate conduits. For example, the anode may be fabricated so that a hole or ring is defined in or by the anode, which hole or ring surrounds and is aligned with the primary gas flow exiting from the tubular cathode. This may take the form of a hole in an anode plate or a wire anode ring through which the gas jet or flow from the tubular cathode is directed.

In the preferred embodiment the source of gas is a source of an inert gas, such as helium, neon, argon, or xenon and operates at atmospheric pressures in air or in a chamber filled with a selected gas. However, it is to be understood that reactive gases may be substituted according to the desired application.

The plasma formed by the apparatus in the illustrated embodiment is an efficient source of ozone, may be used as a ozonator, and is also a good source of ultraviolet emissions. In the illustrated embodiment because of the resistance of the stainless steel tubes to oxidation damage, the apparatus is capable of operating continuously in excess of at least 100 hours without replacement of the conductive hollow elongate conduits or tubes.

The invention is also defined as a method comprised of steps for performing the forgoing functions, namely a method comprising the steps of providing a conductive hollow elongate conduit having a longitudinal axis and an exit orifice; providing an anode electrically coupled to the voltage source and positioned at least at one point in time longitudinally distanced from the exit orifice of the conductive hollow elongate conduit; applying a negative voltage of direct or low frequency current to the conductive hollow elongate conduit; and supplying a gas to the conductive hollow elongate conduit, so that upon application of the negative voltage to the conductive hollow elongate conduit a plasma is formed at least within the conductive hollow elongate conduit.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 2 is a graph of the I–V characteristics of microjet in atmospheric pressure argon at various cathode-anode gaps of the arrangement of FIG. 1. Argon is flowed through 178 μm hole at 100 sccm in air.

FIG. 3 is a graph of the discharge voltage as a function of cathode-anode gap (L) for various flow rates and hole sizes in atmospheric pressure argon. Discharge current was kept constant at 20 mA.

FIGS. 7(*a*)–7(*c*) are microphotographs of microjets and a graph of the emission spectrum of an argon plasma microjet at atmospheric pressure in tubes with hole diameters of 178 μm in FIGS. 7(*a*) and 508 μm in FIG. 7(*b*). The argon flow rate is 200 sccm and the plasma current is 10 mA. Argon ion lines are indicated by an asterisk.

FIG. 8(*a*) is a block diagram of a plurality of microjets which are individually ballasted by resistors ($R_B$) for parallel operation. Photographs of four microjets simultaneously ignited in Ar with total flow rate=400 sccm, I=60 mA, and $d_{hole}$=178 μm as observed from following views in FIG. 8(*b*) through the screen anode and in FIG. 8(*c*) from the side of the microjet where the cathode-to-anode gap is 2 mm.

FIG. 9(*b*) is a diagrammatic depiction of still another embodiment of the anode-cathode structure of the invention in which the cathode is provided with an enlarged bore to supply the gas to a reduced diameter orifice.

FIG. 9(*c*) is a diagrammatic depiction of yet another embodiment of the anode-cathode structure of the invention in which the cathode and anode are two identically sized tubes aligned end to end and separated by a gap in which the microjet is produced.

FIG. 9(*d*) is a diagrammatic depiction of yet another embodiment of the anode-cathode structure of the invention in which the cathode is arranged as an array of a plurality of tubes supplied with gas from a common manifold.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Extending the principle of operation of hollow cathode microdischarges to a tube geometry according to the invention and as disclosed below allows the formation of stable, high-pressure discharges in a variety of flowing gases including argon, helium, nitrogen, and hydrogen. Direct current discharges are ignited by pressurizing stainless steel capillary tubes ($d_{hole}$=178 μm), which are operated as the cathode, and using a metal grid or plate as the anode. Argon discharges can be sustained at atmospheric pressure with voltages as low as 260V for a cathode-anode gap of 0.5 mm. By increasing the operating voltage, the cathode-anode gap can be increased up to 6 mm and the expansion of the discharge results in the generation of a plasma microjet.

In one embodiment illustrated below, using a molybdenum substrate as the anode, microjets are struck in $H_2/CH_4$ mixtures at 200 Torr to deposit diamond films with well-faceted crystals. Micro-Raman spectroscopy of films shows mainly $Sp^3$ content with slight shifting of the diamond peak from 1332 to 1336 $cm^{-1}$. Optical emission spectroscopy of discharges used for growth confirms the presence of atomic hydrogen and CH radicals. The illustrated embodiment describes the use of a plurality of tubes to form an array of microjets. Ballasting of individual tubes will allow parallel operation of the microjets for larger area materials processing.

Figure 1:
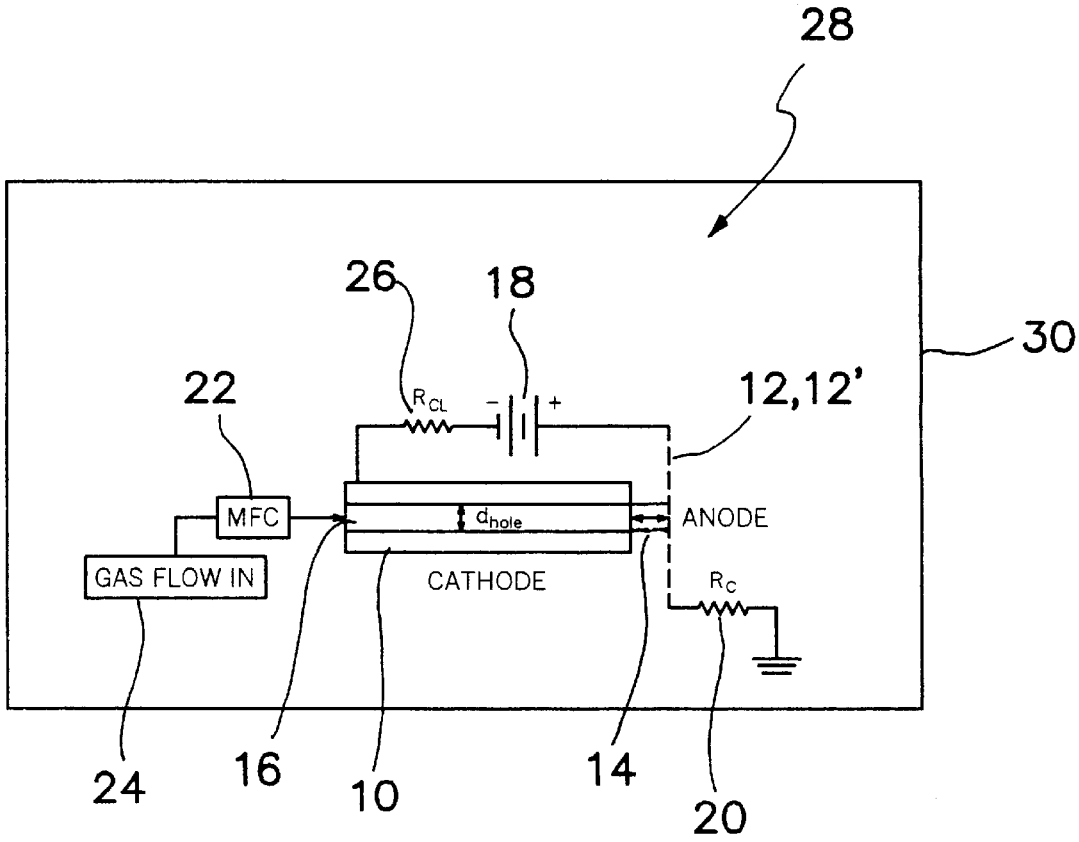
FIG. 1 is a schematic diagram of hollow cathode microjet. $R_{CL}$ and $R_C$ refer to current-limiting and current measuring resistors, respectively.

Experiments to study the electrical properties of the microjet of the invention were done in argon flowing into air at atmospheric pressure. It is to be understood that the choice of the flowing gas, and the pressure of the operating theater are given only as examples, and do not serve to limit the scope of the invention. A diagrammatic depiction of the arrangement of cathode 10 and anode 12 used to generate a hollow cathode microjet 14 is shown in FIG. 1. While in the following cathode 10 will often be described as a cylindrical tube, it is to be expressly understood that cylindrical symmetry of cathode 10 is not essential and that any form of an elongate hollow conduit will be deemed equivalent. Therefore, wherever the term "tube" is used in the specification the more general abstraction of an elongate hollow conduit should be understood. Stainless steel capillary tubes or cathode 10 with holes sizes 16 ranging from 0.005" (125 μm) to 0.020" (508 μm) are available, for example, from Varian, Inc. (HPLC/GC Division, Walnut Creek, Calif.). It is expressly contemplated that the hole size 16 of cathode 10 can be chosen at a range of values from at least from 1 mm or less. Tube or cathode 10 have outside diameters of 0.0625" and may vary in length from 5 to 20 cm. Again, the length of cathode 10 are to be chosen at any value consistent with the teachings of the invention, which include at least lengths of 1 cm to 20 cm.

Normally, tubes or cathodes 10 having a length of 5 cm with 178 μm holes were used in order to avoid pressure requirements departing significantly from atmospheric levels. A negative DC power supply 18 (0–5 kV) was coupled to tube or cathode 10. The anode 12, usually a metallic grid or screen, was held at ground. The distance between the cathode 10 and anode 12 could be varied by moving either the tube 10 or the grid 12 using a linearly adjustable micrometer stage. Plasma current was measured by a resistor 20 in series ($R_C$) with anode 12 and ground. Plasma voltage was measured by a probe (not shown) directly connected to the cathode 10. Gas flow through the tube or tubes 10 was monitored using mass flow controllers 22 coupled to a gas source 24.

In the illustrated embodiment, optical emission spectroscopy was employed to study $H_2/CH_4$ discharges used to grow diamond films by plasma chemical vapor deposition (CVD). Spectra were collected using an optical system consisting of a SPEX 1680 monochromator blazed at 500 nm and Hamamatsu R928 photomultiplier tube. Spectra were taken from the side of the microjet 14 so as to sample species in the flow outside of the tube 10. Diamond growth experiments were performed in vacuum with an electrode arrangement similar to FIG. 1 except for using a substrate 12' as the anode 12 in place of the grid. The substrates 12' were polycrystalline molybdenum foils (99.98% purity) that were etched and cleaned prior to growth. No scratching by diamond powder was necessary to initiate growth. Before each experiment, the discharge chamber 30 in which the apparatus 28 of FIG. 1 was placed, was evacuated to $10^{-4}$ Torr, and then filled with a $H_2/CH_4$ mixture to 200 Torr at a total flow rate of 100 sccm. Substrates 12' were heated resistively to 800° C. with the temperature being measured in situ using an electrically shielded Pt/Pt-Rh thermocouple (not shown). Since the gas flow locally cooled the substrate 12', it was important that the thermocouple made contact directly behind the impingement of the flow. Discharges were struck with the microjet 14 two mm away from the substrate while maintaining a constant current and voltage during the growth. After growing for 2–4 hours, films were characterized by scanning electron microscopy (SEM), energy-dispersive spectroscopy (EDS), and micro-Raman spectroscopy. Micro-Raman of samples was performed using a Renishaw M1000 Raman Spectrometer system with a 514.5 nm Ar laser.

Current-voltage (I–V) traces of an argon microjet 14 are shown in the graph of FIG. 2 for various cathode-anode gaps denoted by the differently shaped icons used to mark the data points. The vertical axis of FIG. 2 is voltage in volts and the horizontal axis is current in mA. Data was obtained by breaking down the gas with the gap as small as possible (<0.5 mm), then moving the anode 12' to extend the discharge. This allowed the voltage required for breakdown to be less than 1 kV. The I–V characteristics were highly reproducible and showed approximately constant voltage dependence over the current ranges measured. For the smallest gap measured, namely 0.5 mm, the discharge or microjet 14 is stable at currents of 2 mA and voltages as low as 260 V. When the current is further reduced, the discharge or microjet 14 extinguishes. The discharge or microjet 14 can be sustained at lower currents if the gap is decreased further, but it becomes difficult to accurately measure such small separations.

As the gap is increased, the plasma voltage increases in a superlinear fashion, as depicted more clearly in the graph of FIG. 3, where gaps from 178 $\mu$m to 508 $\mu$m are depicted. As with FIG. 2, FIG. 3 has a vertical axis showing voltage in volts and a horizontal axis showing current in mA. Furthermore, the minimum current required to sustain the discharge at higher gap values also increases as the gap increases. For example, to increase the gap distance from 1 to 2 mm, the discharge current must be increased from approximately 5 mA to 10 mA. The discharge also becomes increasingly unstable as the distance increases. Over 2.5 mm, high currents, namely >20 mA and high voltages, namely >500 V are required to maintain the plasma.

The current and voltage ranges used for the microjet 14, especially at small gaps, are very similar to those used for argon microdischarges. One major difference, however, is the gas flow which allows the discharge to be increased in length to distances much larger than those used for microdischarges. Also, the absence of a dielectric, which is damaged by the plasma and whose damage is believed to be responsible for the failure of microdischarges, results in a much longer lifetime for discharges of the invention. In our experience, the microjets 14 can be used for hundreds of hours in gases such as argon with almost no damage to the electrodes 10, 12 if the current is kept low (I<10 mA). At higher currents, tubes 10 heat significantly due to the large power density loading, although these effects do not prevent continued use.

Discharge properties were also studied as a function of flow rate and hole diameter. FIG. 3 shows how the voltage changes when increasing the flow rate from 100 to 200 sccm for the same sized electrode gap and increasing the hole size from 178 $\mu$m to 508 $\mu$m. For both hole sizes, as the flow rate is increased, the voltage drops significantly for a given gap. At the higher flow rates, there are also less current fluctuations in the discharge and the overall stability is improved especially at large gaps. In the case of the 178 $\mu$m hole 16, the gap could not be increased over 2.5 mm even at the higher flow rate (for a maximum current of 20 mA). Using a larger hole size allows the gap to be increased to 6 mm with a voltage not significantly larger than that for the 178 $\mu$m hole at a gap of 2.5 mm. Interestingly, all the curves show a similar superlinear shape that is reduced in steepness as the flow rate and hole size increase.

The nature of the flow itself may be responsible for some of the effects observed. Changes in the flow rate and hole size will decrease and increase the flow velocity and result in transitions between different flow regimes. This may be why the different hole sizes show drastically different discharge characteristics at the same flow rates.

Figure 4:
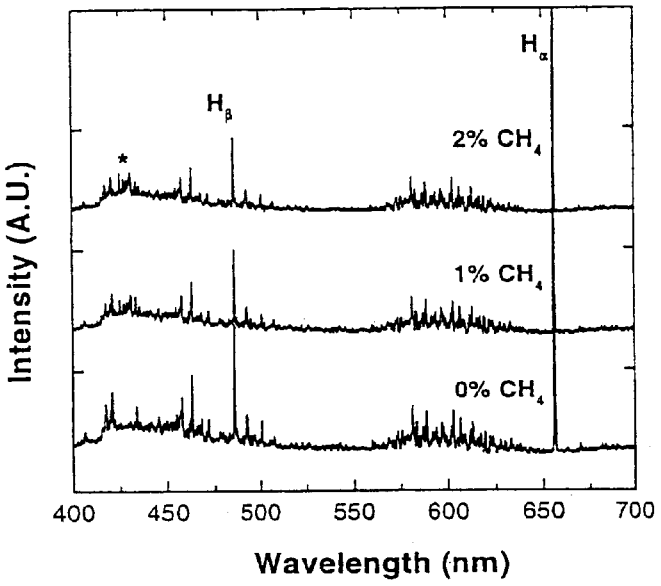
FIG. 4. is a graph of the emission spectra of hydrogen and $H_2/CH_4$ plasma microjets at 200 Torr, with discharge current of 20 mA and total flow rate of 100 sccm. Spectra were collected from the side of discharge with a cathode-anode gap of 2 mm.

In the illustrated embodiment microjets 14 were struck in $H_2/CH_4$ discharges at pressures between 100 and 500 Torr in order to demonstrate their application as a plasma source for diamond growth. The appearance of the discharge differed from the argon microjet 14 by filling the volume between the cathode 10 and anode 12' rather than forming a well-defined jet 14. In the center of this plume, an intense discharge near the hole 16 could be observed that was attributed to the hollow cathode 10. For the pressures studied, the discharge was remarkably stable over a wide range of currents (5–20 mA) and could be run for hundreds of hours with very little damage to the tube or cathode 10. Representative spectra of the hydrogen and $H_2/CH_4$ discharges are shown in the graph of FIG. 4. The vertical axis of FIG. 4 is intensity of the discharge in A.U. and the horizontal axis is the wavelength in nm. Lines are shown for 0%, 1% and 2% $CH_4$. In pure hydrogen, the strongest emissions are from atomic hydrogen Balmer lines at 486.1 and 656.3 nm, noted as $H_\beta$ and $H_\alpha$, respectively. Many of the other lines in the spectrum are weaker H atom lines and $H_2$ excited lines. When methane is added, lines near 430 nm appear, indicated by an asterisk, which are excited bands of the CH system. These lines increase in intensity with increasing methane concentrations. No lines corresponding to $C_2$ or $CH^+$ were observable.

Figure 5:
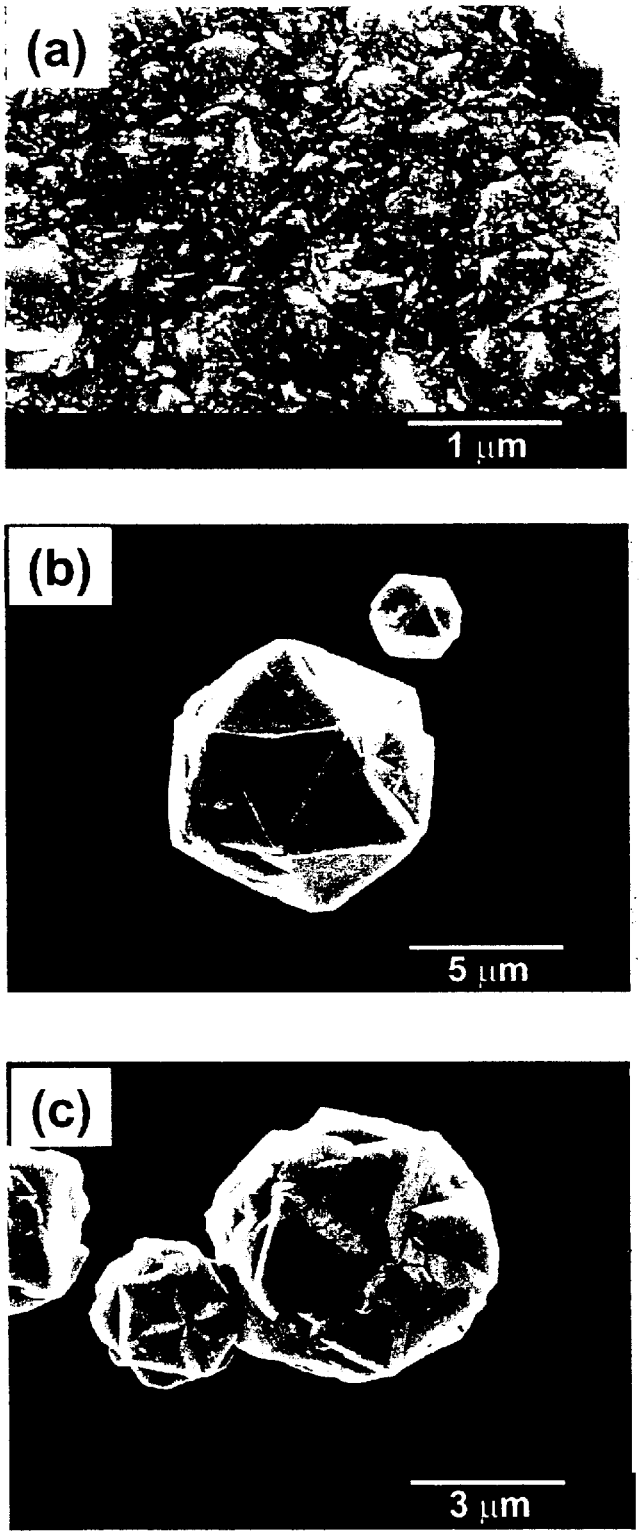
FIGS. 5(*a*)–(*c*) are SEM microphotograph images of diamond films grown at 200 Torr on molybdenum ($T_s$=800° C.) for 2 hours at methane concentrations of FIG. 5(*a*) 0.5%, FIG. 5(*b*) 0.25%, and FIG. 5(*c*) 0.1%.
Figure 9A:
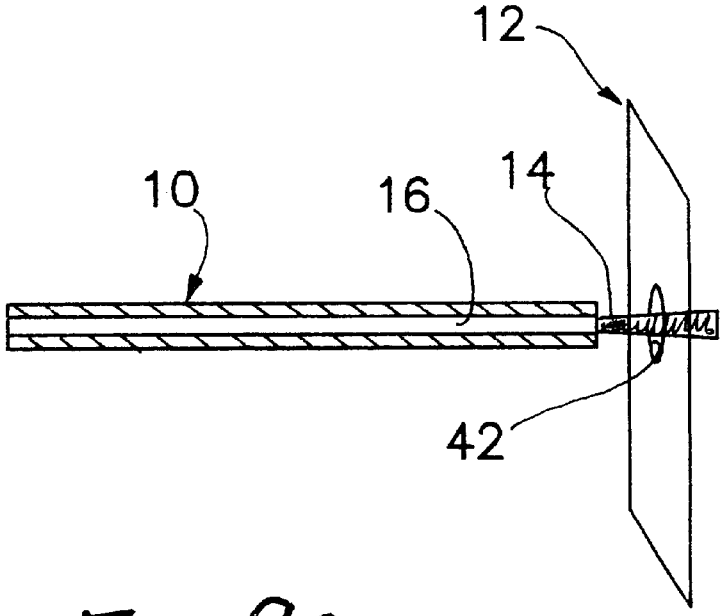
FIG. 9(*a*) is a diagrammatic depiction of another embodiment of the anode-cathode structure of the invention in which a hole aligned with the microjet is defined through a metallic anode plate.
Figure 9B:
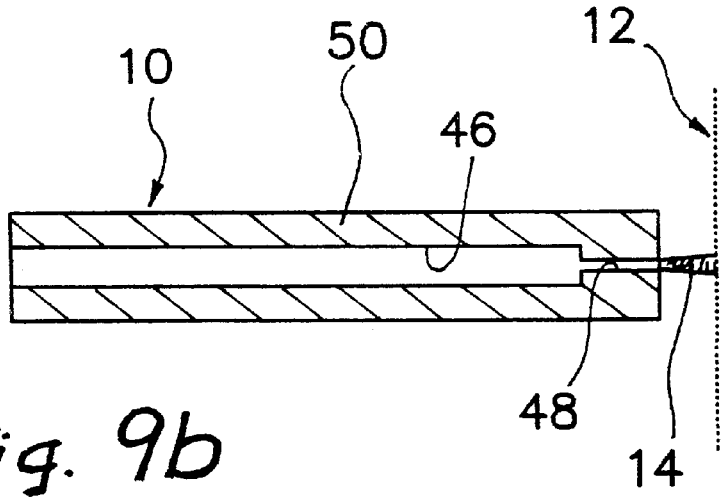
Figure 9C:
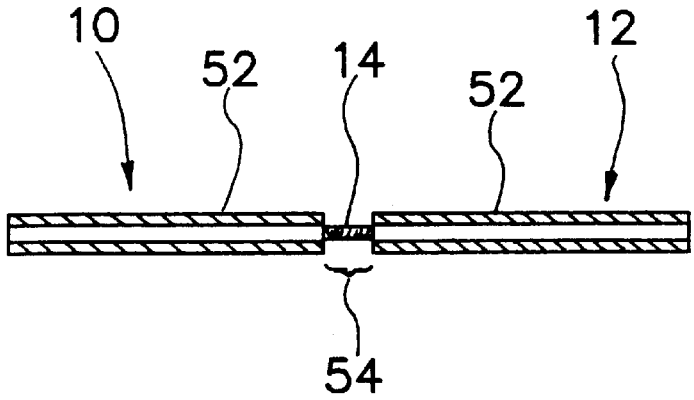
Figure 9D:
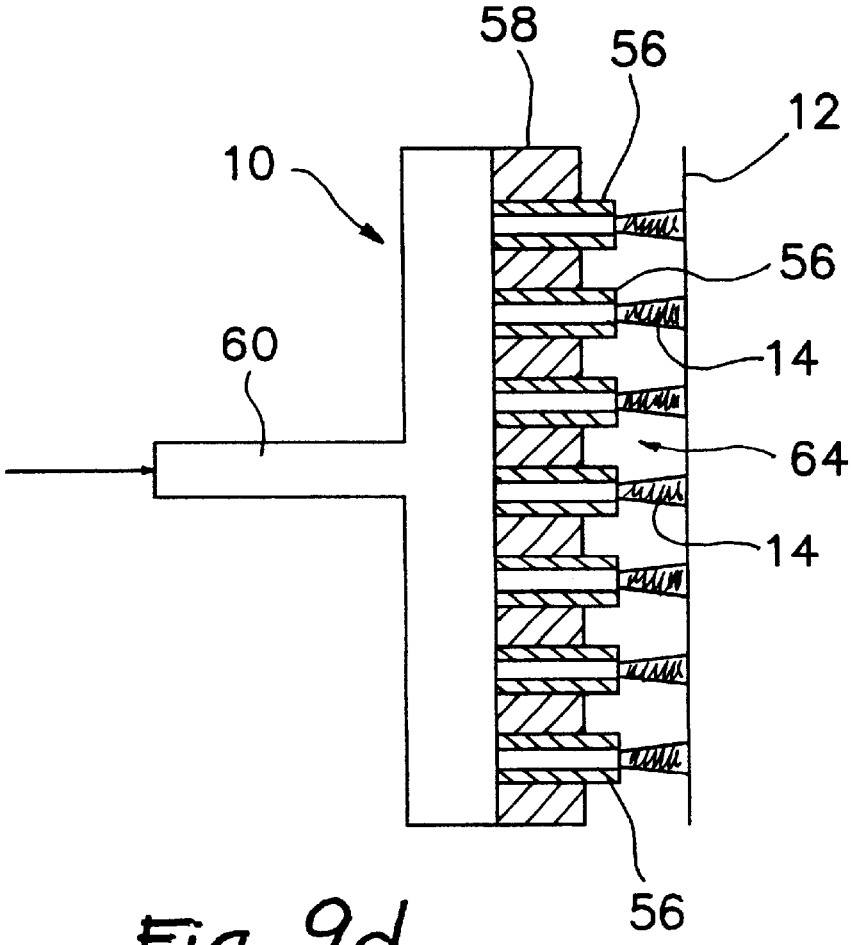

A single microjet 14 was used to grow diamond films using gas mixtures with varying methane concentrations. It is expressly contemplated that multiple microjets 14 may also be used such as diagrammatic shown in FIG. 8 described below. For discharge currents of 20 mA, experiments could be run for several hours with the same tube or cathode 10. The EDS of films did not detect any contamination from the electrode. Scanning electron microscope (SEM) images showed that the growth rate and morphology of deposited films on anode 12' depend strongly on the methane flow rate with significant changes below 1 sccm. At flow rates of 0.5 sccm, deposition resulted in a somewhat continuous film over a 508 $\mu$m diameter area. A close-up of the film as shown in the microphotograph of FIG. 5(*a*) shows micro-scale roughness and some triangular faceting representative of diamond. As the methane flow rate was decreased to 0.25 and 0.1 sccm, as shown in FIG. 5(*b*) and FIG. 5(*c*) respectively, the films consisted of particles with more well-defined faceting. Due to a decrease in the growth rates, the films showed sparse coverage with the heaviest concentration of particles at the center of the film. This type of particle growth has been observed in techniques that also used stagnation flow geometries except that in their case the growth rate was lower along the stagnation line. The larger growth rate at the center may be due to the geometry of the hollow cathode 10 where the highest concentration of excited states is expected.

Figure 6:
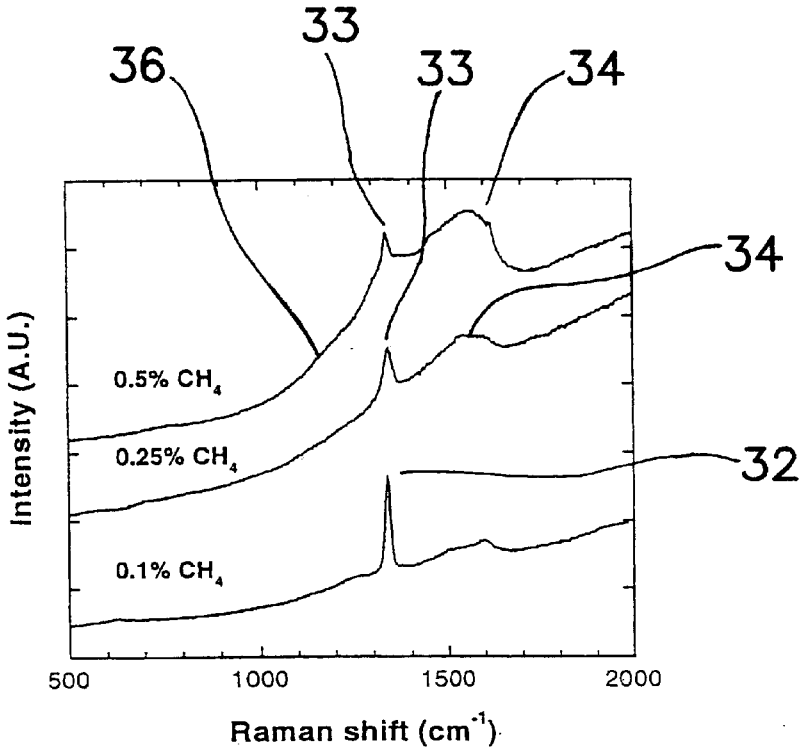
FIG. 6 is a graph of micro-Raman spectra of diamond films of FIGS. 5(*a*)–(*c*) grown for 2 hours at various methane concentrations.

To detect the degree of $sp^3$ versus $sp^2$ content, micro-Raman spectra were obtained as shown in the graph of FIG. 6 for each of the samples in FIGS. 5(*a*)–(*c*). FIG. 6 shows a Raman shift in $cm^{-1}$ on the horizontal axis against intensity in A.U. on the vertical axis. The sharp peak 32 at approximately 1336 $cm^{-1}$ is close to that of the first order optical phonon mode of natural diamond, which occurs at 1332.5 $cm^{-1}$. The shifting of the peak 32 may be due to compressive stresses caused by the underlying $Mo_2C$ layer used for anode 12'. At higher methane concentrations, broad peaks 33 and 34 at 1350 and 1580 $cm^{-1}$ respectively are also present which are due to amorphous carbon phases. At 0.5%, there is also a shoulder 36 at approximately 1150 $cm^{-1}$ that has been attributed to smaller diamond crystals. As the methane concentration is reduced, these peaks disappear and a microcrystalline diamond phase film is grown.

These results show that the microjet 14 can be used as a reactive source for the deposition of high quality films. It is expressly contemplated within the scope of the invention that in other applications the reactive gas may be $N_2$, $O_2$, $CH_4$, $CF_4$ or other chemically active gases used in materials processing. The advantage of this tool is the simplicity of operation and low power consumption, requiring less then 10 W of DC power to grow films. The coatings are restricted to small areas, but this may be advantageous for applications in MEMS where processing on the microscale is desirable. Larger area and thicker films are also possible since tubes can be operated in parallel by resistive ballasting as shown in FIG. 8 below, and due to the stability of the source, it is possible to deposit films continuously or perform continuous sheet deposition for much longer times.

Emission of a discharge in flowing Ar verified the presence of Ar neutrals and ions with spectral features similar to that found in a hollow cathode discharge. In the embodiment illustrated in the graph of FIG. 7(*c*), for a hole size of 508 $\mu$m, the intensity of argon ion lines is much less than that found for a hole size of 178 $\mu$m. The smaller hole size operates as a hollow cathode where as the larger hole forms a surface discharge. To take advantage of the properties of a hollow cathode, the hole size must be in the proper size regime. For example, FIG. 7(*a*) is a microphotograph of the microjet seen at a slight perspective view through an aperture defined through an anode plate as described above in connection with FIG. 9(*a*). The plasma at the orifice of the conduit is seen slightly to the left and below the main plasma ball which is disk like in its surface presentation. On the other hand, FIG. 7(*b*) shows the plasma at the orifice of the conduit is seen slightly to the right and below the main plasma surface, which is actually a toroid, and the end of the flow or shaft of the microjet being seen through the hole of the torus as a termination of the flow. The graph (b) of FIG. 7(*c*) corresponding to the plasma jet of FIG. 7(*b*) is also missing several higher, desired energy peaks, which are shown in the graph (a) of FIG. 7(*c*) which corresponds to the plasma jet of FIG. 7(*a*).

Further evidence of the potential applications of the microjet 14 is shown by the ability to operate them in parallel. By ballasting individual tubes or cathodes 10 as shown in the diagram of FIGS. 8(*a*)–(*c*) with identical resistors 26*a*–26*d* ($R_B$) as diagrammed in FIG. 8(*a*), up to four Ar discharges have been ignited each with similar visible properties as a single microjet. The invention is not limited to any specific number of cathodes 10 and four are chosen only for illustrative purposes. As expected, the breakdown and sustaining voltages were similar to that for a single microjet 14, while the total current quadrupled. FIGS. 8(*b*) and 8(*c*) are photos of four microjets 14 observed through the anode screen 12 and from the side, respectively. In FIG. 8(*c*), features of the jet are seen to include a color change from blue near the end of the capillary tube to red near the screen. Our experience with these devices makes it clear that increasing the number of tubes for large-scale applications is also possible, only limited by the total current available from the power supply.

FIG. 9(*a*) is a diagrammatic depiction of another embodiment of the anode 12 and cathode 10 structure of the invention. The anode 12 in this embodiment is a thin metal plate 44 having an aperture 42 defined therethrough with a hole diameter at least as large as the hole or orifice 16 in the cathode 10. The plasma jet 14 expands through the anode 12 through aperture 42, allowing it to be used downstream without any other electrodes. This is especially important for processing of insulating materials.

FIG. 9(*b*) is a diagrammatic depiction of still another embodiment of the anode 12 and cathode 10 structure of the invention. The cathode 10 in this embodiment is a tube 50 with two different hole sizes; the smaller hole 48 is the source of the plasma and is near the anode 12 and the larger hole 46 is the inlet for gas in tube 50. If the total length of the tube is L, the smaller hole 48 has a length equal to x while the larger hole 46 has a length L−x. The length x is variable but should be at least the diameter of the smaller hole 48. The larger hole 46 extends over most of the length of the tube 50, reducing the pressure drop across the tube 50 and therefore reducing the pressure required for flow of gas. The smaller hole 48 at the distal end of the tube 50 is required for hollow cathode operation at high pressures.

FIG. 9(*c*) is a diagrammatic depiction of yet another embodiment of the anode 12 and cathode 10 structure of the invention. The cathode 10 and anode 12 are both tubes 52 with similar hole diameters. The discharge jet 14 forms near the ends of each tube 52 between the gap 54. This geometry can be used for processing of gases such as the destruction of volatile organic compounds (VOCs). Also, gases can be flowed through the discharge jet 14 and analyzed downstream by attaching the end of the anode 12 to an instrument such as a gas chromatograph (GC).

FIG. 9(*d*) is a diagrammatic depiction of another embodiment of the anode 12 and cathode 10 structure of the invention. For large scale processing, a plurality of metal capillaries 56 can be placed in an array 64 of two dimensions in a dielectric holder 58. A single gas inlet 60 can be used to flow gas through a manifold 62 to the array 64 and multiple discharges 14 can be ignited to form a shower head of plasma microjets. If the discharges 14 are placed in close proximity, the plasma jets will overlap and form a large area plasma.

In summary, stable DC operation of hollow cathode microjets 14 is shown in the illustrated embodiment to be possible in atmospheric pressure argon over a range of voltages and currents. Discharges are flow-stabilized and can be increased in length up to 6 mm. These discharges operate similarly to microdischarges, but due to the flow of gas, should be more easily incorporated into materials processing. Towards this end, the growth of diamond films are illustrated using microjets in $H_2/CH_4$. The application of the concept of a microjet 14 to other gases is possible as our experience with gases such as helium, nitrogen, and oxygen indicate. For this reason, the stability of the source in a variety of inert and reactive gases at high pressures lends itself to a variety of new materials applications on a microscale.

Characteristics of the microjet include but are not limited to:

1) Atmospheric operation
2) Low operating voltages
3) Long life and stability
4) Ability to ignite multiple microjets in parallel
5) Intense source of UV light
6) Generates ozone during operation in air
7) Microscale plasma/ion/electron source usable on microchips Applications for which the invention is advantageously applied include but are not limited to:

1) UV source for lighting and spectroscopic applications
2) Ozonators
3) Materials processing including surface cleaning, deposition, and welding or cutting
4) Gas conversion
5) Detoxification
6) Microthrusters for space propulsion
7) Parallel processing for screening of materials Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, anode 12 has been shown to be plate, screen or grid, which is directly downstream in the flow of microjet 14. It is expressly contemplated that anode 12 may be movable, so that microjet 14 is initiated with anode 12 in one position which is optimal for initiation, and then is moved or removed to allow operation of microjet 14 in a different configuration once operation of microjet 14 is initiated. For example, anode 12 may be directly down stream on initiation, then rotated or folded around the end of cathode 10 to lie in more a radially defined position or positions. Similarly, a secondary ground or anode 12 may be concentrically provided near the orifice of tube 10 and current flow redirected thereto by the repositioning or removal of the primary downstream anode 12.

For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. An apparatus for combination with a source of gas comprising:

a conductive hollow elongate conduit having a longitudinal axis and an exit orifice;

a voltage source of direct or low frequency current having a terminal electrically coupled to the conductive hollow elongate conduit; and an anode electrically coupled to the voltage source and positioned at least at one point in time longitudinally distanced from but proximate to the exit orifice of the conductive hollow elongate conduit to allow striking of a discharge between the exit orifice and the anode, where the conductive hollow elongate conduit is maintained by the voltage source at a potential lower than the anode;

wherein the source of gas is communicated with the conductive hollow elongate conduit to supply gas to the conductive hollow elongate conduit, so that upon application of the voltage to the conductive hollow elongate conduit a plasma is formed at least within the conductive hollow elongate conduit, which plasma may be formed at atmospheric pressures.

2. The apparatus of claim 1 further comprising a source of gas.

3. The apparatus of claim 1 where the source of gas provides a flow of gas through the conductive hollow elongate conduit so that a microjet of the plasma extends from the exit orifice and wherein the anode is downstream from the exit orifice.

4. The apparatus of claim 1 where the source of gas provides gas to the conductive hollow elongate conduit so that the plasma extends to the exit orifice.

5. The apparatus of claim 1 where the plasma generated by the apparatus is characterized by high ultraviolet emissions.

6. The apparatus of claim 1 where the voltage source operates at between 500–1500 volts.

7. The apparatus of claim 1 where the plasma is formed by the apparatus at atmospheric pressures.

8. The apparatus of claim 1 where is used for materials processing and the anode is grounded.

9. The apparatus of claim 1 where is used for materials processing and the anode is a conductive grid.

10. The apparatus of claim 1 where is used for materials processing and the anode is movable while the plasma is sustained.

11. The apparatus of claim 1 where is used for materials processing and the anode is removable at least in part while the plasma is sustained.

12. The apparatus of claim 1 further comprising a plurality of conductive hollow elongate conduits, each having a longitudinal axis and an exit orifice with a gas flow therein independent of gas flow in other ones of the plurality of conduits, where the voltage source has a common terminal electrically coupled to each of the conductive hollow elongate conduits, and where the anode is positioned at least at one point in time longitudinally distanced from the exit orifice of each of the conductive hollow elongate conduits but proximate thereto to allow striking of a discharge between each of the exit orifices and the anode.

13. The apparatus of claim 1 where the plasma is continuous and formed by the apparatus at atmospheric pressures in air.

14. The apparatus of claim 13 where the plasma is formed by the apparatus generates ozone.

15. A method comprising:

providing a conductive hollow elongate conduit having a longitudinal axis and an exit orifice;

providing an anode electrically coupled to the voltage source and positioned at least at one point in time longitudinally distanced from but proximate to the exit orifice of the conductive hollow elongate conduit to allow striking of a discharge between the exit orifice and the anode;

applying a voltage of direct or low frequency current to the conductive hollow elongate conduit, where the conductive hollow elongate conduit is maintained at a potential lower than the anode; and supplying a gas to the conductive hollow elongate conduit, so that upon application of the voltage to the conductive hollow elongate conduit a plasma is formed at least within the conductive hollow elongate conduit even at atmospheric pressures.

16. The method of claim 15 further comprising generating ultraviolet emissions.

17. The method of claim 15 where applying a negative voltage applies a voltage of between 500–1500 volts.

18. The method of claim 15 further comprising generating ozone.

19. The method of claim 15 where supplying a gas to the conductive hollow elongate conduit so that upon application of the voltage to the conductive hollow elongate conduit, a plasma is formed at atmospheric pressures.

20. The method of claim 19 where forming the plasma at atmospheric pressures is continuously formed at atmospheric pressures in air.

21. The method of claim 15 further comprising providing a plurality of conductive hollow elongate conduits, each having a longitudinal axis and an exit orifice with a gas flow therein independent of gas flow in other ones of the plurality of conduits, applying a common voltage to each of the conductive hollow elongate conduits, and positioning the anode at least at one point in time longitudinally distanced from the exit orifice of each of the conductive hollow elongate conduits but proximate thereto to allow striking of a discharge between each of the exit orifices and the anode.

22. The method of claim 15 further comprising providing a source of gas.

23. The method of claim 15 where supplying a gas to the conductive hollow elongate conduit comprises flowing gas through the conductive hollow elongate conduit so that a microjet of the plasma extends from the exit orifice and impinges on the anode which is downstream from the exit orifice.

24. The method of claim 15 where supplying a gas to the conductive hollow elongate conduit comprises extends a plasma to the exit orifice.

25. The method of claim 15 further comprising employing the plasma in the form of microjets for the processing of materials and grounding the anode.

26. The method of claim 15 further comprising employing the plasma in the form of microjets for the Processing of materials and where providing an anode provides a conductive grid.

27. The method of claim 15 further comprising employing the plasma in the form of microjets for the processing of materials and moving the anode after initiation of the plasma and while the plasma continues to be sustained.

28. The method of claim 15 further comprising employing the plasma in the form of microjets for the processing of materials and moving at least a portion of the anode after initiation of the plasma and while the plasma continues to be sustained.

29. An apparatus for combination with a source of gas comprising:

a conductive hollow elongate conduit having a longitudinal axis and an exit orifice;

a voltage source of direct or low frequency current having a negative terminal electrically coupled to the conductive hollow elongate conduit; and an anode electrically coupled to the voltage source and positioned at least at one point in time longitudinally distanced from the exit orifice of the conductive hollow elongate conduit;

wherein the source of gas is communicated with the conductive hollow elongate conduit to supply gas to the conductive hollow elongate conduit, so that upon application of the voltage to the conductive hollow elongate conduit, so that upon application of the voltage to the conductive hollow elongate conduit a plasma is formed at least within the conductive hollow elongate conduit, wherein the conductive hollow elongate conduit is a cylindrical tube with an inner diameter of approximately 200 $\mu$m or less.

30. A method comprising:

providing a conductive hollow elongate conduit having a longitudinal axis and an exit orifice;

providing an anode electrically coupled to the voltage source and positioned at least at one point in time longitudinally distanced from the exit orifice of the conductive hollow elongate conduit applying a negative voltage of direct or low frequency current to the conductive hollow elongate conduit; and supplying a gas to the conductive hollow elongate conduit, so that upon application of the negative voltage to the conductive hollow elongate conduit a plasma is formed at least within the conductive hollow elongate conduit, wherein providing a conductive hollow elongate conduit provides a cylindrical tube with an inner diameter of approximately 200 $\mu$m or less.

31. An apparatus for combination with a source of gas comprising:

a conductive hollow elongate conduit having a longitudinal axis and an exit orifice;

a voltage source of direct or low frequency current having a negative terminal electrically coupled to the conductive hollow elongate conduit; and an anode electrically coupled to the voltage source and positioned at least at one point in time longitudinally distanced from the exit orifice of the conductive hollow elongate conduit;

wherein the source of gas is communicated with the conductive hollow elongate conduit to supply gas to the conductive hollow elongate conduit, so that upon application of the voltage to the conductive hollow elongate conduit a plasma is formed at least within the conductive hollow elongate conduit, where the apparatus is capable of operating continuously in excess of at least 100 hours without replacement of the conductive hollow elongate conduit.

32. A method comprising:

providing a conductive hollow elongate conduit having a longitudinal axis and an exit orifice;

providing an anode electrically coupled to the voltage source and positioned at least at one point in time longitudinally distanced from the exit orifice of the conductive hollow elongate conduit applying a negative voltage of direct or low frequency current to the conductive hollow elongate conduit; and supplying a gas to the conductive hollow elongate conduit, so that upon application of the negative voltage to the conductive hollow elongate conduit a plasma is formed at least within the conductive hollow elongate conduit, where further comprising operating continuously in excess of at least 100 hours without replacement of the conductive hollow elongate conduit.

* * * * *